United States Patent [19]

Satoh

[11] 4,366,357

[45] Dec. 28, 1982

[54] HIGH FREQUENCY HEATING APPARATUS

[75] Inventor: Seiichi Satoh, Fujinomiya, Japan

[73] Assignee: Tokyo Shibaura Denki Kabushiki Kaisha, Kawasaki, Japan

[21] Appl. No.: 223,302

[22] Filed: Jan. 8, 1981

[30] Foreign Application Priority Data

Jan. 21, 1980 [JP] Japan ..... 55-5400

[51] Int. Cl.[3] ..... H05B 6/68

[52] U.S. Cl. ..... 219/10.55 B; 219/10.55 R

[58] Field of Search ..... 219/10.55 B, 10.55 F, 219/10.55 R, 10.55 D, 10.55 M

[56] References Cited

U.S. PATENT DOCUMENTS 3,320,396 5/1967 Boehm ..... 210/10.55 B
3,569,656 3/1971 White et al. ..... 219/10.55 B
4,133,998 1/1979 Otani ..... 219/10.55 B
4,177,370 12/1979 Otani ..... 219/10.55 B

FOREIGN PATENT DOCUMENTS 2922085 12/1979 Fed. Rep. of Germany .
54-123748 9/1979 Japan ..... 219/10.55 B
2021367 11/1979 United Kingdom ..... 219/10.55 B
2021368 11/1979 United Kingdom ..... 219/10.55 B

*Primary Examiner*—B. A. Reynolds
*Assistant Examiner*—Philip H. Leung
*Attorney, Agent, or Firm*—Cushman, Darby & Cushman

[57] ABSTRACT

A magnetron and a steam generator are alternately and periodically energized by a variable power controller, and the microwave and steam outputs are controlled in a correlative fashion by varying the ratio of the periods of energization of the magnetron and steam generator.

3 Claims, 20 Drawing Figures

FIG. 11
| | SW1 | SW2 | C | D |
|---|---|---|---|---|
| COOKING | | | | |
| DEFROST | | | | |
| OVEN | | | | |
| STEAM | | | | |
| | 15A | 15A | 3A | 15A |
FIG. 12
| | X | Y |
|---|---|---|
| FERMENTATION | | |
| OVEN | | |
| GRILL | | |
| | 15A | 10A |
FIG. 14A
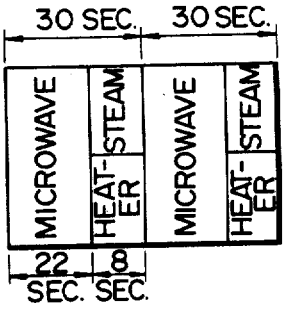
FIG. 14B
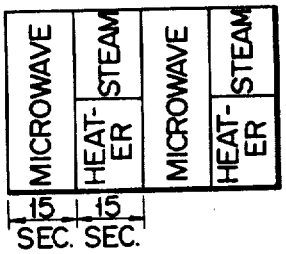
FIG. 13
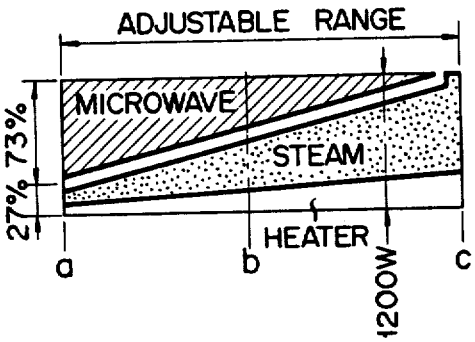
FIG. 14C
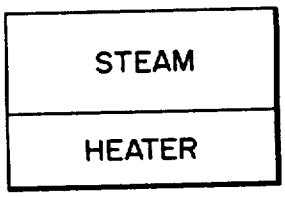

HIGH FREQUENCY HEATING APPARATUS

This invention relates to apparatus for heating foodstuff by microwave or by a suitable combination of steam and electrical heat and, more particularly, to a microwave heating apparatus provided with a power controller for varying the alternately generated microwave and steam outputs in correlative fashion.

Recently, high frequency heating apparatus which make use of steam introduced into a heating chamber for microwave heating in order to obtain satisfactory heating have been used. Typically, microwave and steam are alternately produced for constant periods. With this apparatus, satisfactory heating can be obtained where the foodstuff to be heated, contains moderate moisture. However, if the foodstuff has a high moisture content, the steam is liable to be excessive, resulting in an excessively moist result. On the other hand, if the foodstuff has a low moisture content is likely to be dried. In either case, it is often the case that satisfactory heating cannot be obtained. Particularly, in the case of the foodstuff containing much moisture, it is likely that the steam is condensed to form water drops attached to the inner wall of the heating chamber and that water drops formed on the ceiling of the heating chamber fall onto the foodstuff. Further, it is necessary to clean the water drops attached to the heating chamber inner wall after the heating is ended.

An object of the invention, accordingly, is to provide a high frequency heating apparatus which has a complicated function that the alternately generated microwave and steam outputs can be varied in a correlative fashion depending upon the kind of the foodstuff to be heated, particularly upon the moisture content thereof.

Another object of the invention is to provide a high frequency heating apparatus, which is constructed such that no water drop will be formed on the inner wall, particularly the ceiling, of the heating chamber when heating foodstuff by a combination of microwave and steam.

According to the invention, there is provided a high frequency heating apparatus, which comprises a heating chamber, a magnetron for supplying microwave to the heating chamber, a steam generator for supplying steam to the heating chamber, a power controller for alternately and periodically energizing the magnetron and steam generator and varying the periods of energization of the magnetron and steam generator, and a heating mode switching means including a select switch for switching a first heating mode using the power controller and a second heating mode in which the magnetron and steam generator are independently energized.

Also, according to the invention, there is provided a high frequency heating apparatus, which further comprises an electric heater disposed near the inner wall, for instance the ceiling, of the heating chamber and a means for energizing the heater when foodstuff is heated in the aforementioned first heating mode using both microwave and steam.

This invention can be more fully understood from the following detailed description when taken in conjunction with the accompanying drawings, in which:

FIGS. 11 and 12 are views showing the operation of select switches in the embodiment of FIG. 10; and FIGS. 13 through 18 are views illustrating the operation of the embodiment shown in FIG. 10.

Figure 1:
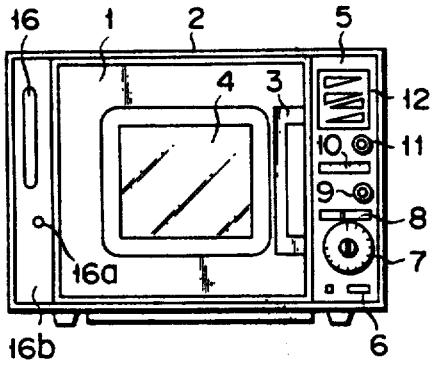
FIG. 1 is a front view showing an embodiment of the high frequency heating apparatus according to the invention.

The invention will now be described in conjunction with some preferred embodiments with reference to the accompanying drawings. FIG. 1 is an elevational view showing an embodiment of the high frequency heating apparatus according to the invention. In the Figure, a door 1 is hinged to a case 2 at the left hand end, and it is provided at its right end with a handle 3 for opening and closing it. It is provided with a window 4, through which the inside of a heating chamber can be looked at. The front side of the case 2 has an operating section 5 provided at the right hand end. This section 5 has a heating switch 6, a timer 7, a select switch 8, a temperature controller 9, a temperature display section 10, a mechanical power control dial 11 and a power control display section 12. The operating section 5 is shown in detail in FIG. 2. As is shown, it has three pilot lamps **14*a*, 14*b* and 14*c* provided on the left side. The pilot lamp 14*a* is turned on by a power control display section 12*a* when the heating is done by the sole microwave heating. The pilot lamp 14*b* is turned on by the display section 12*b* when the heating is done by alternate microwave and steam heating in an inversely proportional fashion. The pilot lamp 14*c* is turned on by the display section 12*c* when the heating is made by the sole steam heating. A display pointer 15 is provided common to the display sections 12*a*, 12*b* and 12*c*. By turning the control dial 11, the display pointer 15 is moved to left or right, whereby the display content is changed and also power control is effected in a manner to be described later. Reference numeral 16 designates a water level observation window of a water supply tank which is used for a steam generator to be described later. The water supply tank can be taken out by opening a door 16*b*, which can be opened by depressing a push button 16*a* provided below the window 16**.

Figure 3:
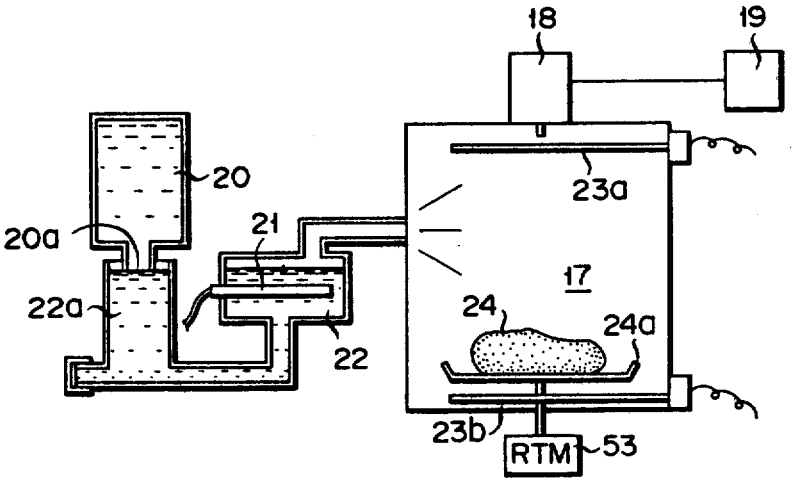
FIG. 3 is a schematic sectional view showing the inner construction of the apparatus shown in FIG. 1.

FIG. 3 schematically shows the internal structure of the high frequency heating apparatus shown in FIG. 1. Designated generally at 17 is a heating chamber, and a magnetron 18 for supplying microwave to the heating chamber 17 is provided on top of the heating chamber 17. The magnetron 18 is energized by a high voltage generator 19. A water supply tank 20 is provided behind the water level observation window 16 shown in FIG. 1. The water supply tank 20 is communicated with a steam generator 22 having an internal steam heater 21 through a water level adjustment tank **22*a*, and steam produced when the steam heater 21 is energized is led into the heating chamber 17. As water is reduced by the steam generation, the steam generator 22 can be automatically replenished with water from the water supply tank 20 by the action of a valve provided at a water supply port 20***a* of the tank 20. Electric heaters 23*a* and 23*b* are provided near the inner wall of the heating chamber 17, i.e., its ceiling and bottom walls. Reference numeral 24 designates foodstuff to be heated, for instance a piece of meat, placed on a rotary dish 24*a* which is driven by a rotary table motor (RTM) 53 provided at the bottom of the chamber 17.

Figure 4:
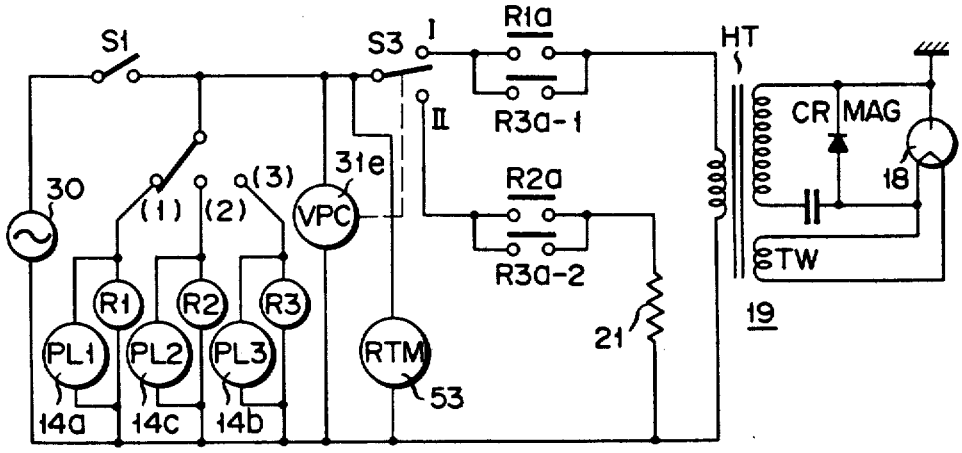
FIG. 4 is a circuit diagram showing the circuit of the embodiment of FIG. 1.

FIG. 4 shows a connection diagram of this embodiment. In the Figure, one end of an AC power source 30 is connected through a power source switch $S_1$ to a movable contact of a power control switch $S_3$ of a variable power controller (VPC). A VPC motor 31*e* and the RTM 53 are connected across the AC power source 30. The power control switch $S_3$ has two fixed contacts I and II. The fixed contact I is connected through a relay switch $R_{1a}$ to one end of the primary winding of a high voltage generation transformer HT, the end of which is connected to the other end of the power source 30. The secondary winding of the high voltage generation transformer HT is connected through a high voltage rectifier circuit consisting of a high voltage rectifier CR and a high voltage capacitor to the anode and cathode of the magnetron 18. The transformer HT has a tertiary winding TW which is connected to the cathode of the magnetron 18. A circuit inserted between the transformer HT and magnetron 18 is a high voltage generator 19. A relay switch $R_{3a-1}$ is connected in parallel with the relay switch $R_{1a}$.

The other fixed contact II of the power control switch $S_3$ is connected through relay switches $R_{2a}$ and $R_{3a-2}$ in parallel with each other to one end of a steam heater 21, the other end of which is connected to the other end of the power source 30. In FIG. 4, the circuit for energizing the heaters 23*a* and 23*b* is not shown.

The aforementioned end of the power source 30 is also connected through the switch $S_1$ to a movable contact of a select switch 8 and also to one end of the motor 31*e* of variable power controller (VPC). The other end of the motor 31*e* of the VPC is connected to the other end of the power source 30. With the rotation of the motor 31*e*, the movable contact of the power control switch $S_3$ is moved so that it is brought into contact with the fixed contacts I and II. The period for one rotation of the motor shaft of the VPC motor 31*e* is very accurately set to a predetermined period, for instance 30 seconds, and this period of 30 seconds can be freely shared between the periods, during which the movable contact of the VPC switch $S_3$ is in contact with the respective fixed contacts I and II. The proportions of these periods can be controlled by turning the power control dial 11 shown in FIG. 2.

Figure 5:
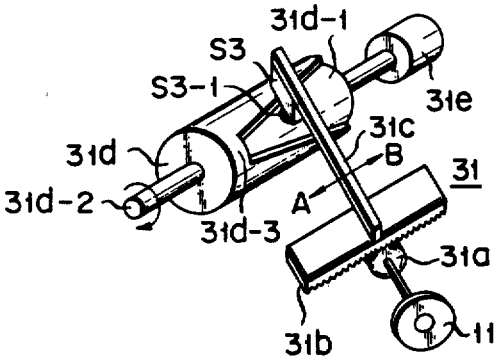
FIG. 5 is a perspective view showing the mechanical construction of a variable power controller shown in FIG. 4.

FIG. 5 shows an example of the construction of the variable power controller 31. The power control dial 11 is coupled to a pinion gear 31*a* which is in mesh with a rack 31*b*. A switch support 31*c* is secured at one end to the upperside of the central position of the rack 31*b* in the longitudinal direction thereof, and it supports a power control switch $S_3$ secured to its other end. The power control switch $S_3$ is, for instance, a microswitch having a downwardly projecting actuator $S_{3-1}$ for driving the movable contact. The actuator $S_{3-1}$ is driven by a rotary cam 31*d*. The cam 31*d* has a cam groove 31*d*-1 with the width thereof varying gradually in the longitudinal direction. The cam groove 31*d*-1 extends in the axial direction of the cam 31*d* over the entire length thereof, except for one end portion 31*d*-3 thereof. The shaft 31*d*-2 is rotated in the direction of arrow by the VPC motor 31*e*. The VPC motor 31*e* is connected to the AC power source 30 and energized when the power switch $S_1$ shown in FIG. 4 is turned on.

By turning the power control dial 11, the rack 31*b* is moved in the direction of arrow A or B through the pinion 31*a*, thus moving the rack 31*b*, switch support 31*c* and power switch $S_3$ in either direction A or B. While the actuator $S_{3-1}$ of the power switch $S_3$ is found within the cam groove 31*d*-1 during the rotation of the cam 31*d*, its movable contact is connected to the fixed contact II. Thus, when the switch $S_3$ is moved in the direction of arrow A, the period during which the movable contact is in contact with the fixed contact I is increased to increase the output of the magnetron 18, while the output is reduced by the movement of the switch $S_3$ in the direction of arrow B. When the actuator $S_{3-1}$ comes onto the one end portion 31*d*-3 of the cam 31*d*, the switch $S_3$ is held in contact with the fixed contact I and the output of the magnetron 18 becomes full power.

Figure 6:
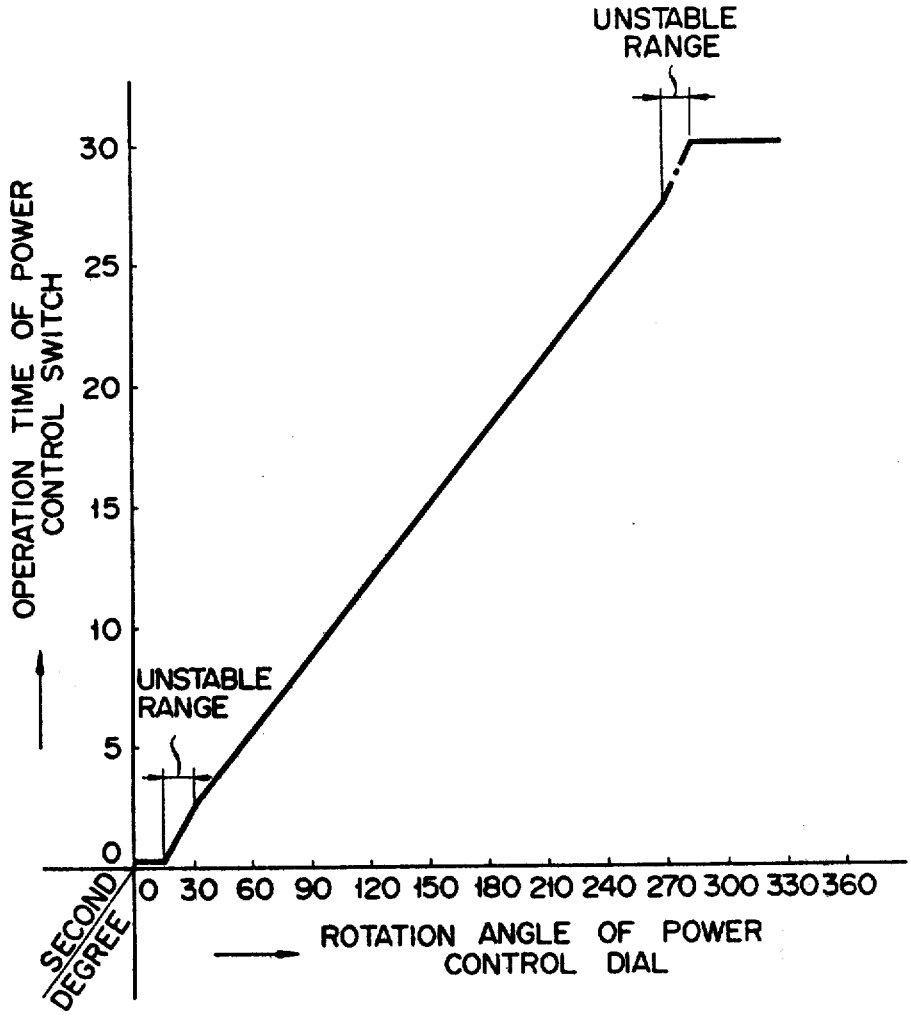
FIG. 6 is a graph showing the relation between the rotational angle of a power control dial of the variable power controller and the operation period of the power control switch.

FIG. 6 shows a relation of switching period of the power control switch $S_3$ and rotational angle of the power control dial 11. As can be seen from FIG. 6, when the dial 11 is rotated up to the angle of about 150 degrees, the switching period is set at about 15 seconds, so that the switch $S_3$ switches approximately once every 15 seconds. Actually, the rotational angle ranges of the dial 11 between 15 and 30 degrees and between 270 and 285 degrees are instable ranges.

Returning to FIG. 4, the select switch 8 has three fixed contacts (1), (2) and (3). The first fixed contact (1) is connected to one end of a parallel circuit consisting of a first relay $R_1$ and a pilot lamp ($PL_1$) 14*a*, the second fixed contact (2) is connected to one end of a parallel circuit consisting of a second relay $R_2$ and a pilot lamp ($PL_2$) 14*c* and the third fixed contact (3) is connected to a parallel circuit consisting of a third relay $R_3$ and a pilot lamp ($PL_3$) 14*b*. These three parallel circuits have their other ends connected to the other end of the power supply 30.

Figure 8:
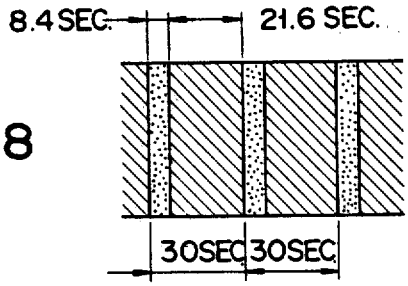
Figure 9:
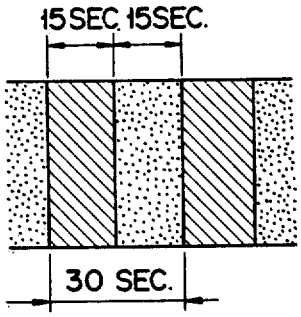

The operation of the embodiment shown in FIGS. 1 through 6 will now be described with reference to FIGS. 7 through 9. In the first place, the power source switch $S_1$ shown in FIG. 4 is closed. If it is assumed that the select switch 8 is in its state with its movable contact connected to the fixed contact (1) as shown in FIG. 4, with the closure of the power source switch $S_1$ the relay $R_1$ is energized to close the relay switch $R_{1a}$, and at the same time the pilot lamp ($PL_1$) 14*a* alone is turned on. Further, the VPC motor 31*e* is energized. As a result, the power control switch $S_3$ is operated such that its movable contact is alternately connected to the fixed contacts I and II with the cycle period of 30 seconds. While the switch $S_3$ is connected to the side of the fixed contact I, the relay switch $R_{1a}$ is held closed. Thus, during this period the high voltage generator 19 including the high voltage transformer HT is energized to energize the magnetron 18, and microwave is thus supplied to the heating chamber 17 to heat the foodstuff 24.

In this case, if the switch $S_3$ is positioned at the center of the cam 31*d* in the longitudinal direction thereof, the switch $S_3$ is switched to the side of the fixed contact II after, for instance, 15 seconds, from the start of the energization of the magnetron 18. Since at this time the relays $R_2$ and $R_3$ are "off" and the relay switches $R_{2a}$ and $R_{32-2}$ are "off", the steam heater 21 is not energized, so that no steam is supplied to the heating chamber 17.

After 15 seconds are elapsed, the VPC cam 31d is returned to the initial state with the switch $S_3$ connected to the side of the contact I to energize the magnetron 18 again. In this way, when the select switch 8 is in its state with its movable contact connected to the fixed contact (1), only the magnetron 18 is energized, so that the heating is made only by the microwave heating. In this case, the microwave output can be controlled within a range from the minimum output $W_0$ to the maximum output W as shown in (a) in FIG. 7 by operating the VPC dial 11. For example, when the dial 11 is set to a medium output position, the control switch $S_3$ is switched from the contact I to the contact II immediately before the lapse of 15 seconds from the switching of it to the contact I, and in this case the microwave output has one half the maximum value. When the dial 11 is set to the maximum output position, the switching of the switch $S_3$ to the contact II occurs immediately before the lapse of 30 seconds, and in this case the microwave output has the maximum value W.

When the select switch 8 is switched to the contact (2), the relay $R_2$ is energized to close the relay switch $R_{2a}$, and at the same time the pilot lamp 14c is turned on. As a result, the relay switches $R_{1a}$, $R_{3a\text{-}1}$ and $R_{3a\text{-}2}$ are all rendered "off". Thus, the magnetron 18 will not be energized even when the power control switch $S_3$ is switched to the side of the contact I. In this case, only the steam heater 21 is thus intermittently energized, and steam produced in the steam generator 22 is supplied to the heating chamber 17. The steam output can be adjusted within a range from the lowest output $Q_0$ to the highest output Q as shown in (c) in FIG. 7, and this adjustment can be obtained by operating the VPC dial 11 like the case of the microwave output mentioned above.

When the select switch 8 is switched to the contact (3), only the relay $R_3$ is energized, and the two relay switches $R_{3a\text{-}1}$ and $R_{3a\text{-}2}$ are rendered "on". At this time, the pilot lamp 14b is turned on. As a result, when the power control switch $S_3$ is switched to the side of the contact I, the magnetron 18 is energized through the relay switch $R_{3a\text{-}1}$, and when the switch $S_3$ is switched to the side of the contact II the steam heater 21 is energized through the relay switch $R_{3a\text{-}2}$.

Figure 2:
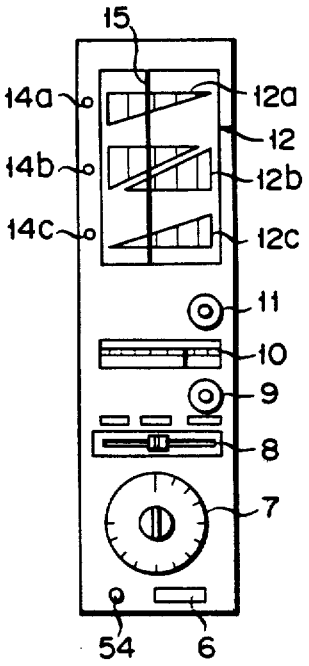
FIG. 2 is an enlarged-scale view showing an operating section shown in FIG. 1.
Figure 7:
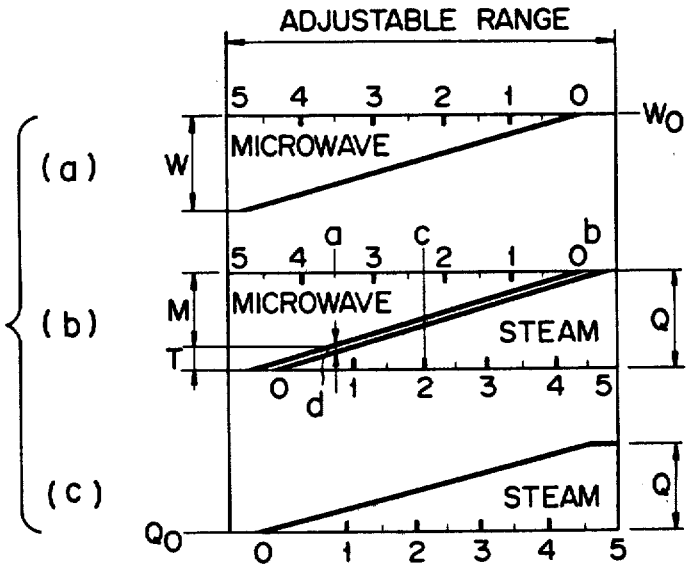
FIGS. 7 through 9 are views illustrating the operation of the embodiment shown in FIGS. 1 through 4.

If the pointer 15 shown in FIG. 2 is at a point a shown in (b) in FIG. 7, the microwave output generation period percentage M is 72% or, in terms of time, this corresponds to 21.6 seconds, while the steam generation period percentage T is 28% corresponding to 8.4 seconds. In other words, the period of the state of the power control switch $S_3$ with its movable contact connected to the side of the contact I is 21.6 seconds of the total of 30 seconds, and the period of the switch state with its movable contact connected to the side of the contact II is the other 8.4 seconds as shown in FIG. 8. When the pointer 15 is moved to a point c as shown in (b) in FIG. 7 by operating the dial 11, the microwave output is reduced, while the steam output is increased. At this position c of the pointer 15, both the microwave and steam output percentages are 50%, that is, the switch $S_3$ is in its state connected to the side of the contact I for 15 seconds and in its state connected to the side of the contact II for the remaining 15 seconds. The relation of the microwave and steam output generation periods when the pointer 15 is at the point a is as shown in FIG. 8, and the relation of these periods when the pointer is at the point c is as shown in FIG. 9.

As has been described, when the select switch 8 is in its state with its movable contact connected to the contact (2), the microwave and steam are alternately supplied to the heating chamber 17 with the cycle period of 30 seconds. Also, by operating the VPC dial 11 in this state, the microwave and steam output percentages can be freely varied in an inversely proportional fashion. Besides, the VPC dial 11 can be operated while watching the pointer 15 in the operating section 5 as shown in FIG. 2, which is very convenient.

With this embodiment, at the time of steam cooking or microwave cooking the steam output or microwave output can be controlled independently. When cooking is done with both steam and microwave, the proportion of steam and microwave heating can be varied. As a result, the heating can be done in various modes, making possible very sophisticated heating control so that the food can be cooking perfectly to taste. In addition, various controls as mentioned above can be obtained by using a single VPC, so that not only superior operation control property can be obtained but also it is possible to reduce cost. Further, the aforementioned three different heating modes can be displayed by the respective pilot lamps 14a to 14c in the "on" state thereof. Furthermore, since the individual variable control states are separately displayed, the apparatus is very convenient to use, and erroneous operation can be prevented.

Moreover, while the above embodiment is provided with the microwave and steam generators, it is also possible to incorporate an electric heater in the heating chamber to extend the scope of heating applications. The electric heater has hitherto been added to the high frequency heating apparatus so that the apparatus can be used as an oven or a grill for broiling fish or the like use. However, fine output adjustment of the electric heater has not been provided, so that it has been very inconvenient to use the electric heater.

FIGS. 10 through 18 show another embodiment, in which the above inconvenience is improved.

Figure 10:
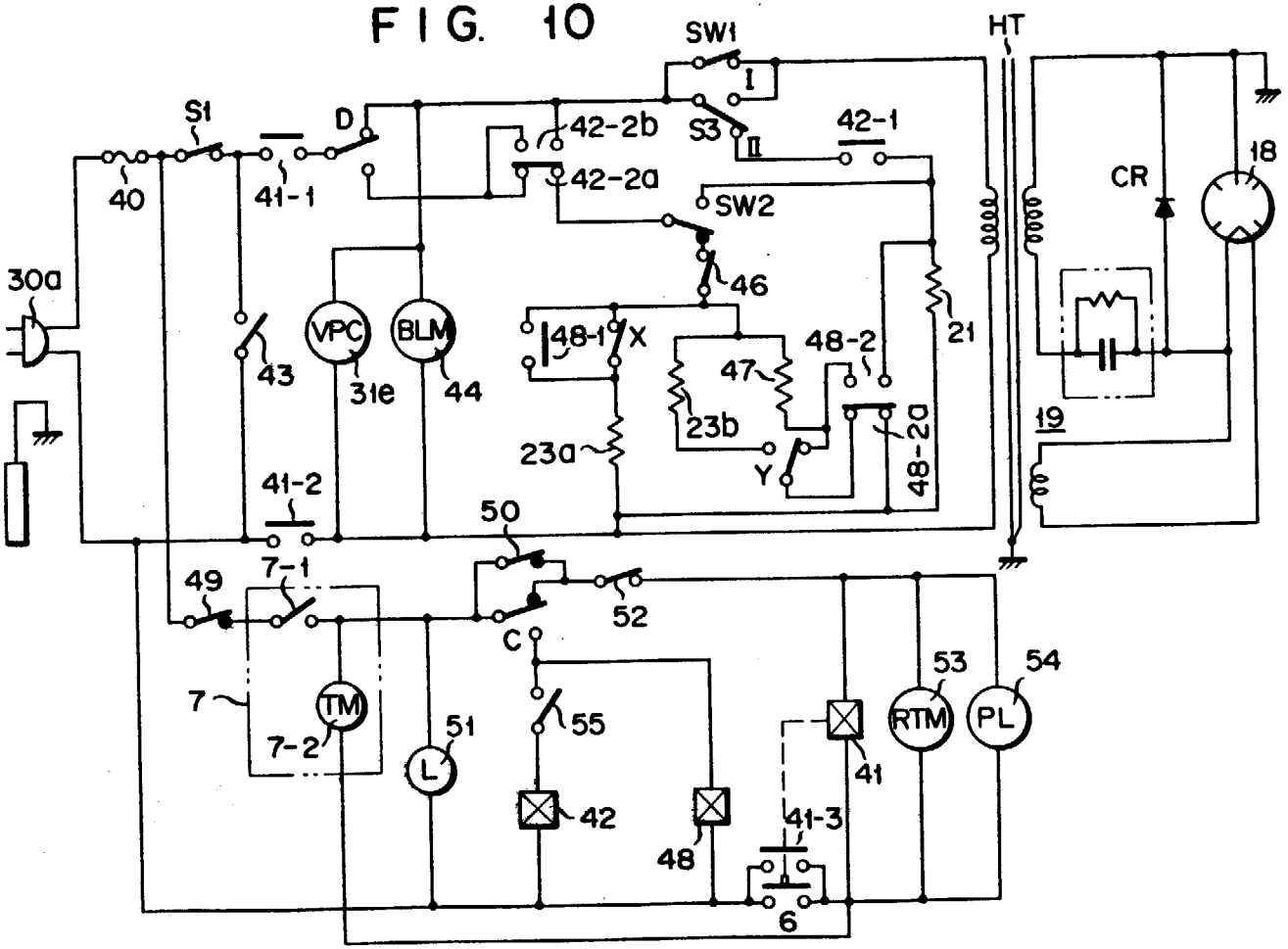
FIG. 10 is a circuit diagram showing the circuit of another embodiment of the invention.

Referring now to FIG. 10, a power source plug 30a has one end connected in turn to a fuse 40, a power source switch $S_1$, and a relay switch 41-1 and a select switch D, and one contact thereof is connected to a movable contact of the VPC switch $S_3$ and to a movable contact of a select switch $SW_1$. One fixed contact I of the VPC switch $S_3$ is connected together with a contact of the select switch $SW_1$ to one end of the primary winding of a high voltage transformer HT, the other end of which is connected through a relay switch 41-2 to the other end of the power source plug 30a. The other fixed contact II of the VPC switch $S_3$ is connected through a relay switch 42-1 to one end of the steam heater 21, the other end of which is connected through a relay switch 41-2 to the other end of the power source plug 30a. A short-circuit switch 43 is provided between the juncture between the power source switch $S_1$ and the relay switch 41-1 and the source side terminal of the relay switch 41-2. A VPC motor 31e is connected between the other contact of the select switch D and the load side contact of the relay switch 41-2, and a blow motor (BLM) 44 is connected in parallel with the VPC motor 31e. The other fixed contact of the select switch D is connected through a normally closed switch 42-2a of a relay 42 to a select switch $SW_2$. One fixed contact of the switch $SW_2$ is connected to one end of a steam heater 21. A normally open switch 42-2b of the relay 42 is connected between the two fixed contacts of the select switch D. The other fixed contact of the select switch $SW_2$ is connected through a thermostat switch 46 to one end of an inner upper heater 47, one end of a lower heater 23*b*, a select switch X and a switch 48-1 of a relay 48. The other end of the inner upper heater 47 is connected through a switch 48-2 of the relay 48 to the aforementioned one end of the steam heater 21 and one fixed contact of a select switch Y. The other fixed contact of the select switch Y is connected to the other end of the lower heater 23*b*, the movable contact of which is connected through a normally closed switch 48-2*a* of the relay 48 to the other end of the power source. The other end of the outer upper heater 23*a* is connected to the other end of the power source.

The juncture between the fuse 40 and power source switch $S_1$ is connected through a thermal switch 49 of magnetron and a timer switch 7-1 of a timer 7 to one end of a timer motor (TM) 7-2, a movable contact of a select switch C and one end of a lamp (L) 51. One fixed contact of the select switch C is connected through a lock switch 52 to a relay 41, a rotary table motor (RTM) 53 for the rotary table 24*a* and a heating display lamp (PL) 54. The other ends of the timer motor (TM) 7-2, relay 41, motor (RTM) 53 and display lamp (PL) 54 are commonly connected to the juncture between a relay switch 41-3 and a cooking switch 6. The other ends of relay switch 41-3 and the cooking switch 6 are connected together with the other ends of relays 42 and 48 and lamp (L) 51 to the other end of the power source. A time sharing bimetal switch 55 is connected between the other fixed contact of the select switch C and relay 42. The select switches $SW_1$, $SW_2$, C and D correspond to the select switch 8 shown in FIG. 2, and they are formed as a four-ganged-slide-switch unit. Likewise, the switches X and Y are formed as a two-ganged-slide-switch unit.

The operation of the embodiment shown in FIG. 10 will now be described with reference to FIGS. 11 through 18. When the four-ganged-slide-switch unit is set to a "cooking" position as shown in FIG. 11, the switches $SW_1$, $SW_2$, C and D are switched to a collective state which corresponds to their states shown in FIG. 11. In this state, by closing the power source switch $S_1$ the timer 7 is set, and by depressing the cooking switch 6 the relay 41 is activated to close the switch 41-3, whereby the relay 41 is self-sustained in the activated state. At the same time the relay switches 41-1 and 41-2 are closed, whereby the VPC motor 31*e* and blower motor (BLM) 44 are driven. As a result, the magnetron 18 is continuously energized through the select switch $SW_1$. At this time, the relay 42 is not energized, so that neither the steam heater 21 nor the heaters 23*a*, 23*b* and 47 are energized. In this case, the heating is thus done by the sole microwave heating. The microwave output obtained at this time is maximum.

When the four-ganged-slide-switch unit is set to a "defrosting" position as shown in FIG. 11, the select switch $SW_1$ is opened while the other switches $SW_2$, C and D remain in the same state as before. As a result, the magnetron 18 is energized only when the power control switch $S_3$ is switched to the side of the contact I with the operation of the VPC motor 31*e*. In this case, the adjustment of the microwave output can be made like the case shown in (a) in FIG. 7.

When the four-ganged-slide-switch unit is set to an "oven" position as shown in FIG. 11, only the select switch D is switched with the other switches remaining in the same state as in the case of the "defrosting" position. As a result, a circuit through the relay switch 42-2*a*, select switch $SW_2$ and thermostat switch 46 is made. Since the relay 48 is not energized in this case, the normally closed relay switch 42-2*a* remains closed. In this state, if the two-ganged-slide-switch unit X, Y is in a "grill" position as shown in FIG. 12, the outer upper heater 23*a* and inner upper grill heater 47 are energized. If the two-ganged-slide-switch unit is in an "oven" position as shown in FIG. 12, the select switch Y is switched to the side of the lower heater 23*b*. Thus, the upper and lower heaters 23*a* and 23*b* are energized. If the two-ganged-slide-switch unit is in a "fermentation" position as shown in FIG. 12, the select switch Y is switched to the side of the grill, so that only the inner upper grill heater 47 is energized.

When the four-ganged-slide-switch unit is set to a "steam" position, as shown in FIG. 11, with the select switch C switched to the lower contact side as is shown, the relay 42 is energized through the time sharing bimetal switch 55 to close the switch 42-1, open the normally closed switch 42-2*a* and close the normally open switch 42-2*b*. At the same time, the relay 48 is energized to close the normally open switch 48-2. The select switch $SW_2$ is switched to the side of the steam heater 21.

Figure 15:
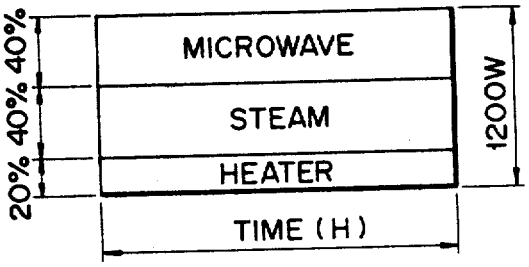

As a result, current is supplied to the relay 41 not through the select switch C but through the steam bimetal switch 50, and the magnetron 18 and steam heater 21 are alternately energized with the operation of the power control switch $S_3$. If the two-ganged-slide-switch unit X, Y is in the "fermentation" position as shown in FIG. 12, the current, when the switch $S_3$ is connected to the side of the steam heater 21, flows through the relay switch 48-2, inner upper grill heater 47, relay switch 48-1 and outer upper heater 23*a* as well as through the steam heater 21. That is, the heating from the magnetron 18 and steam and heater heating by the heaters 21, 47 and 23*a* are alternately effected. Thus, the input power, for instance of 1,200 W, is distributed as shown in FIG. 15, i.e., 40% as microwave output, 40% as steam output and 20% as heater output. In this embodiment, like the previous embodiment of FIG. 4, the individual outputs can be simultaneously varied in an inversely proportional fashion by operating the VPC dial 11. While this can be done through the control of the periods during which the power control switch $S_3$ is connected to the sides of the contacts I and II respectively, since the contact II is connected to the steam heater 21 and heaters 23*a*, 23*b* and 47, the steam output and heater output can be simultaneously adjusted in a proportional fashion. FIG. 13 shows the manner of the output control as described. At one end of the control range, the microwave output occupies 73% of the total input, and the other 27% is shared by the steam and heater outputs. At the other end of the range, the microwave output is zero, and the input is shared between the steam and heater outputs only.

Figure 16:
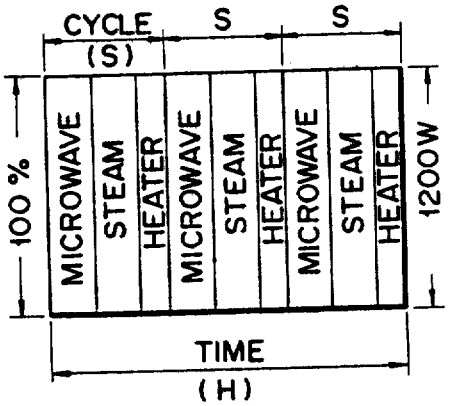
Figure 17:
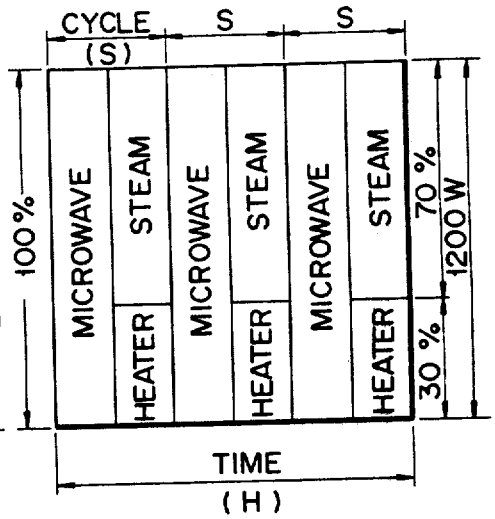

The proportions of the periods during which the power control switch $S_3$ is connected to the sides of the contacts I and II respectively when the pointer 15 is at the position a in FIg. 13 are as shown in FIG. 14A; the period of the switch connected to the side of the contact I is 22 seconds, and the period of the switch connected to the side of the contact II is 8 seconds. When the pointer 15 is at the position b in FIG. 13, the period proportions are as shown in FIG. 14B; the period during which the microwave output is supplied is 15 seconds, and the period during which the steam and heater outputs are supplied is 15 seconds. When the pointer 15 is at the position c, no microwave output is supplied, and the input power is shared solely between the steam and heater outputs as mentioned earlier. FIGS. 16 and 17 show the power distributions shown in FIGS. 14A and 14B in more detail.

When the four-ganged-slide-switch unit shown in FIG. 11 is in the "steam" position and the two-ganged-slide-switch unit is in the "oven" position as shown in FIG. 12, the switch X is closed while the switch Y is connected to the side of the lower heater 23*b*, so that the heater current flows through the inner upper grill heater 47 and outer upper heater 23*a*. When the two-ganged-slide-switch unit is also in the "grill" position, current also flows through the heaters 47 and 23*a*.

As has been shown, in the embodiment of FIG. 10 the steam output, heater output and microwave output are supplied simultaneously or periodically to the heating chamber. Thus, the period of cooking can be reduced compared to the case of the sole microwave heating or heating by the sole steam and heater outputs, and also it is possible to overcome the deficiencies of the principles of either one of these heating processes and improve the finish of the heating or cooking. In addition, the temperature of the heating chamber wall is increased by the heat from the heaters disposed near the wall, so that there is no possibility of condensation of steam, attachment of water drops to the heating chamber wall or dropping of water drops from the ceiling wall onto the foodstuff in the heating chamber, and also the cleaning of the heating chamber after the cooking can be simply made.

Particularly, since the microwave output and steam and heater outputs can be controlled depending upon the foodstuff to be heated, it is possible to select the optimum heating condition for the foodstuff. Further, since the steam and heater outputs are changed in a proportional fashion, that is, since the heater output heat is increased when the steam is increased, it is possible to maintain a condition under which no water drop attached to the heating chamber inner wall is formed. Furthermore, since the ratio of the steam and heater outputs is constant, uniform heating and satisfactory finish as well as various other advantages such as the reduction of the heating period can be obtained.

Figure 18:
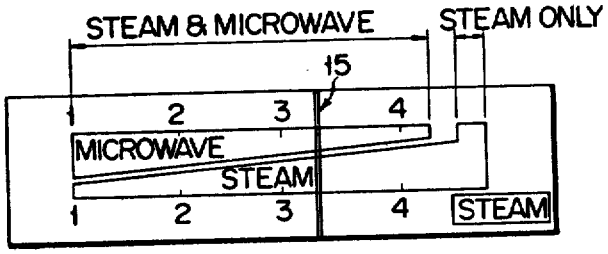

In the embodiment of FIG. 4, the sole microwave heating, heating by the alternate microwave and steam outputs and the sole steam heating can be obtained by appropriately setting the switch 8, and adjustment is made by moving the pointer along the display sections 12*a* to 12*c* shown in FIG. 2. In the case of the heating by the alternate microwave and steam outputs, the ratio of the microwave and steam outputs can be varied with the operation of the switch $S_3$ shown in FIG. 5 caused by operating the power control dial 11. When the switch $S_3$ is moved in the direction of arrow B until the actuator $S_{3\text{-}1}$ gets out of the cam groove 31*d*-1, the switch $S_3$ is locked to its state connected to the side of the contact II. FIG. 18 shows a display section in this connection. When the dial 11 is turned clockwise to a limit position, the pointer 15 is moved to the right end in the Figure to display that the sole steam is supplied to the heating chamber as its maximum output.

What is claimed is:

1. A microwave heating apparatus comprising:

a housing;

a heating chamber disposed in said housing;

a steam generator provided in said housing for supplying steam into said heating chamber;

a microwave generator provided in said housing for radiating microwave energy into said heating chamber;

a first electric heater disposed at an upper portion in said heating chamber for supplying electric heating energy thereinto;

a second electric heater disposed at a lower portion in said heating chamber for supplying electric heating energy thereinto;

control means provided in said housing for controlling the operations of said steam generator, said microwave generator and said first and second electric heaters in the following four modes (a), (b), (c) and (d) of operation:

(a) a first mode wherein only said microwave generator is continuously operated, (b) a second mode wherein only said microwave generator is intermittently operated, (c) a third mode wherein only at least one of said first and second electric heaters are operated, and (d) a fourth mode wherein said microwave generator is repeatedly operated for intermittent periods of time and both said steam generator and said first heater are repeatedly operated for the remaining periods of time; and means for selecting one of said four modes of operation.

2. A high frequency heating apparatus according to claim 1, wherein said control means includes a motor energized during said second and fourth modes, a cam rotated by said motor and having a peripheral cam groove extending in the direction of the axis of rotation, the width of said cam groove continuously varying along said direction of the axis of rotation, a power control switch driven by said cam, and an operation mechanism including a single mechanism for moving said power control switch along said cam groove.

3. A high frequency heating apparatus according to claim 2 or 1, wherein:

said first electric heater includes concentrically disposed outer and inner heaters; and said apparatus further comprises switching means for selectively energizing said outer heater, said inner heater and both said inner and outer heaters, both said heaters being energized whenever said steam generator is energized to prevent the condensation of water drops.

* * * * *